US007644542B2

(12) United States Patent
Ambrozus

(10) Patent No.: US 7,644,542 B2
(45) Date of Patent: Jan. 12, 2010

(54) SLIDING DOOR

(75) Inventor: Stefan Ambrozus, Köln (DE)

(73) Assignee: Cabinet Schranksysteme AG, Kerpen-Buir (DE)

( * ) Notice: Subject to any disclaimer, the term of this patent is extended or adjusted under 35 U.S.C. 154(b) by 589 days.

(21) Appl. No.: 10/558,468

(22) PCT Filed: May 25, 2004

(86) PCT No.: PCT/EP2004/005606

§ 371 (c)(1),
(2), (4) Date: Nov. 28, 2005

(87) PCT Pub. No.: WO2004/106679

PCT Pub. Date: Dec. 9, 2004

(65) Prior Publication Data

US 2007/0017157 A1 Jan. 25, 2007

(30) Foreign Application Priority Data

May 27, 2003 (EP) ..... 03011954

(51) Int. Cl.
*E05D 15/06* (2006.01)

(52) U.S. Cl. ..... 49/425; 49/411

(58) Field of Classification Search ..... 49/504, 49/425, 409, 410, 411, 501; 16/105, 99; 52/656.9, 656.2
See application file for complete search history.

(56) References Cited

U.S. PATENT DOCUMENTS

| | | | | |
|---|---|---|---|---|
| 2,950,756 | A * | 8/1960 | Moloney | 160/91 |
| 3,097,401 | A * | 7/1963 | Riegelman | 49/425 |
| 3,442,052 | A * | 5/1969 | Levine | 49/425 |
| 3,466,698 | A * | 9/1969 | Nystrom | 16/87 R |
| 4,102,009 | A | 7/1978 | Kelly | |
| 4,956,952 | A * | 9/1990 | Bancroft | 52/207 |
| 5,657,591 | A * | 8/1997 | Kitada | 52/204.71 |
| 5,875,600 | A * | 3/1999 | Redman | 52/656.4 |
| 6,813,862 | B2 * | 11/2004 | Perich et al. | 49/425 |

* cited by examiner

*Primary Examiner*—Gregory J. Strimbu
(74) *Attorney, Agent, or Firm*—Alix, Yale & Ristas, LLP

(57) ABSTRACT

A sliding door comprising a door leaf and a frame profile holding the door leaf. The frame profile includes lateral frame profiles and a lower frame profile. Intermediate pieces are disposed in a channel of the lower frame profile and in channels of the lateral frame profiles to connect the lower and lateral frame profiles together. Roller assemblies are disposed in the lower frame profile and are adjusted via screws which extend through the intermediate pieces.

19 Claims, 14 Drawing Sheets

SLIDING DOOR

BACKGROUND OF THE INVENTION

The invention relates to a sliding door with a frame having a lower, an upper and two lateral frame profiles, the lateral frame profiles being screwed to the lower and upper frame profiles, with a door leaf which is held in the frame in retaining channels of the frame profiles, and with upper guide rollers and lower runners which are mounted on retaining elements which can be inserted into the lower channel of the lower frame profile, which channel is designed to have an H-shaped cross section, the retaining elements being provided with a sloping face and having a thread or a nut in which there engages an adjusting screw which is inserted into a mating piece.

Sliding doors of this type are used particularly for closing wardrobes, especially built-in wardrobes. There is a wide variety of doors for closing wardrobes or the like, which frequently also have a frame. In that case, numerous requirements are placed on the frame. It should be easy to assemble. There should also be the possibility of adjusting the height of the doors by adjusting the runners.

It is known from U.S. Pat. No. 4,102,009 that the lower runners of a sliding door are guided in a retaining element with a lateral sloping face, the sloping face having only its upper end bearing against the lateral frame profile and pointing downwardly away therefrom. Tightening a screw which engages through the lateral frame profile into a thread of the retaining element makes it possible to reduce the angle between the sloping face of the retaining element and the lateral frame profile. In this way the runner is moved further downward and the door is raised.

If screws which are not countersunk are used for adjustment purposes (or else for assembling the door), not only do they disturb the otherwise harmonious appearance of the frame or the door. If they have not been screwed in properly but instead stick out somewhat, they may also lead to injuries or to damage to items of clothing taken out of the wardrobe. These problems are to be avoided according to the invention.

The object of the invention is to provide a sliding door of the initially mentioned type in which adjustment of the runners is possible with the aid of countersunk screws.

SUMMARY OF THE INVENTION

The solution according to a preferred embodiment of the invention resides in that at least the retaining channels of the lateral frame profiles are provided at their outer end with striplike projections which constrict the opening, and in that elongate, platelike intermediate pieces designed as mating pieces are fitted onto these projections, the width of which intermediate pieces on the side having the one larger surface corresponds to the width of the retaining channels of the lateral frame profiles behind the striplike projections, the width of which intermediate pieces on the other side corresponds to the width of the lower channel of the H-shaped cross section of the lower frame profile, and the intermediate pieces having between said widths a width which corresponds to the distance separating the striplike projections from one another, and being provided with bores for the insertion of screws.

The lower frame profile has an essentially H-shaped cross section, specifically an upper retaining channel for the door leaf and a lower channel in which the runners are arranged. Corresponding retaining channels for the door leaf are also arranged on the lateral and upper frame profiles. The ends of at least the lateral frame profiles are provided with striplike projections which constrict the opening. An elongate, platelike intermediate piece is fitted onto these projections adjacent to the lower frame profile. This intermediate piece is narrower in the middle between the two surfaces and fits exactly onto the striplike projections at this point. This platelike intermediate piece is wider on the two outer sides, with the result that it cannot be pushed away from the striplike projections transversely with respect to its plate plane. These wider regions on the two plate surfaces fit exactly into the retaining channels of the lateral frame profiles behind the striplike projections and into the lower channel of the H-shaped cross section of the lower frame profile. As a result, the lower frame profile is aligned with the lateral frame profiles. A screw which is fitted into the lateral profile and through the intermediate piece can thus be used to securely screw the arrangement to the lower frame profile at this point. The screw here disappears in the retaining channel of the lateral frame profile and is seated on the intermediate piece. The retaining elements with the runners are then inserted into the lower channel of the H-shaped cross section of the frame profile, specifically in such a way that they have the upper end of their sloping face bearing against the corresponding intermediate piece. The sloping face here, starting from the upper end of the retaining element, where the latter bears against the intermediate piece, points downwardly away from the intermediate piece. If a screw (which is likewise countersunk) is then inserted into the intermediate piece and screwed into the thread or the nut of the retaining element, it is possible by tightening this screw to move the runner further downward and raise the door.

The retaining element here has only its upper edge bearing laterally against the intermediate piece. If this intermediate piece were not present, this edge would press only onto the border of the retaining channel of the lateral frame profile and damage it. By virtue of the intermediate piece, this force is distributed over a large area, with the result that these forces can be absorbed without deforming or damaging the lateral frame profiles.

This arrangement makes it possible to fasten the lower frame profile to the lateral frame profiles using countersunk screws and also to use countersunk screws for the adjustment. There are thus no screws sticking out in the lower region of the door, which means that the stated risk of injury is not present. In the upper region of the door, which is normally out of reach, it is not as essential to provide countersunk screws here too for fastening the lateral frame profiles to the upper frame profile. In an advantageous embodiment, however, the lateral frame profiles are designed as hollow profiles with intermediate walls extending in the longitudinal direction and perpendicularly to the door plane. Fastening screws can then engage on these intermediate walls, which means that these screws are likewise countersunk.

The striplike projections constricting the opening must be provided on the lateral frame profiles. However, provision may also be made for all the retaining channels of the frame profiles to be provided at their outer end with striplike projections which constrict the opening, in which case the retaining channels no longer hold the door leaf over their whole surface area but only along these strip surfaces.

In an advantageous embodiment, flat elements comprising elastic material are mounted on the lateral edges of the door. These act as impact buffers if the door strikes against a lateral wall, a frame or the like.

Flat elements here have the advantage over larger-volume impact buffers that they are not conspicuous and are also perfectly capable of producing an esthetic effect. At the same time, the flat elements can also be used to cover screw holes behind which the countersunk screws are arranged.

The sliding door is advantageously mounted in a frame with stop faces for the door.

The frame profiles will normally be produced from metal, for example aluminum. However, these frame profiles are expediently clad with wooden profiles, thereby giving the visual impression of a wooden door yet maintaining the advantages of a stable metal construction.

The frame in which the door is mounted is also expediently clad with wood.

The sliding door is expediently additionally provided with a handle, in particular in the form of a handle strip, by means of which the door can be opened.

BRIEF DESCRIPTION OF THE DRAWINGS

The invention will be described by way of example hereinbelow with the aid of advantageous embodiments with reference to the appended drawings, in which:

FIG. 1 shows an overall view of the arrangement of doors for closing a built-in wardrobe or the like;

DETAILED DESCRIPTION OF THE PREFERRED EMBODIMENTS

Figure 1:
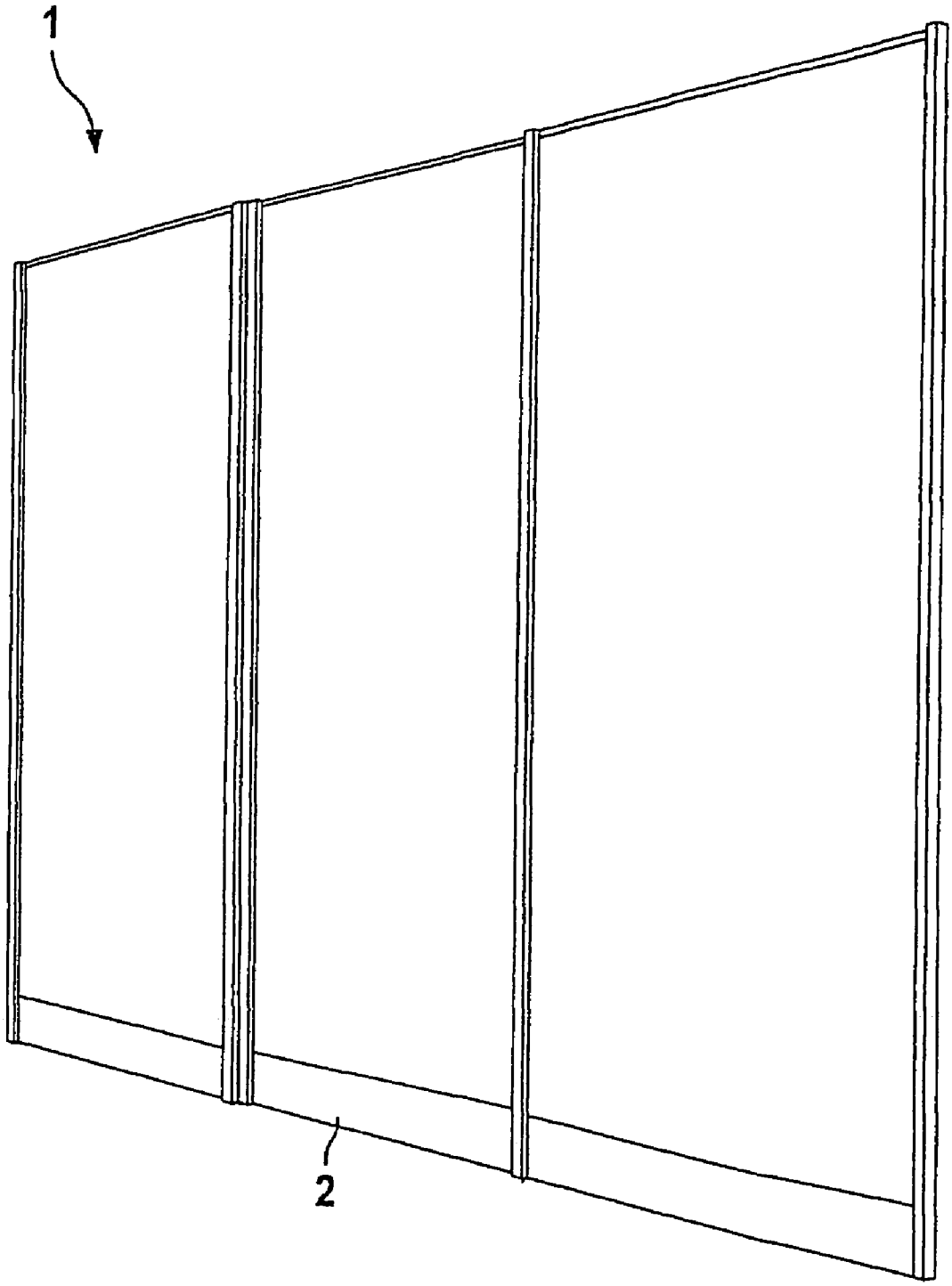

FIG. 1 shows doors 1 with a frame 2 as they actually appear to the eye. The doors produce a particularly esthetic effect by virtue of the frames 2, which may be of very narrow design. The width of the frame parts depicted in FIGS. 2 to 15 is significantly increased in order to illustrate the invention. During the actual execution of the invention, however, the frame parts will have, in comparison with the door, the dimensions which can be seen from FIG. 1.

Figure 2:
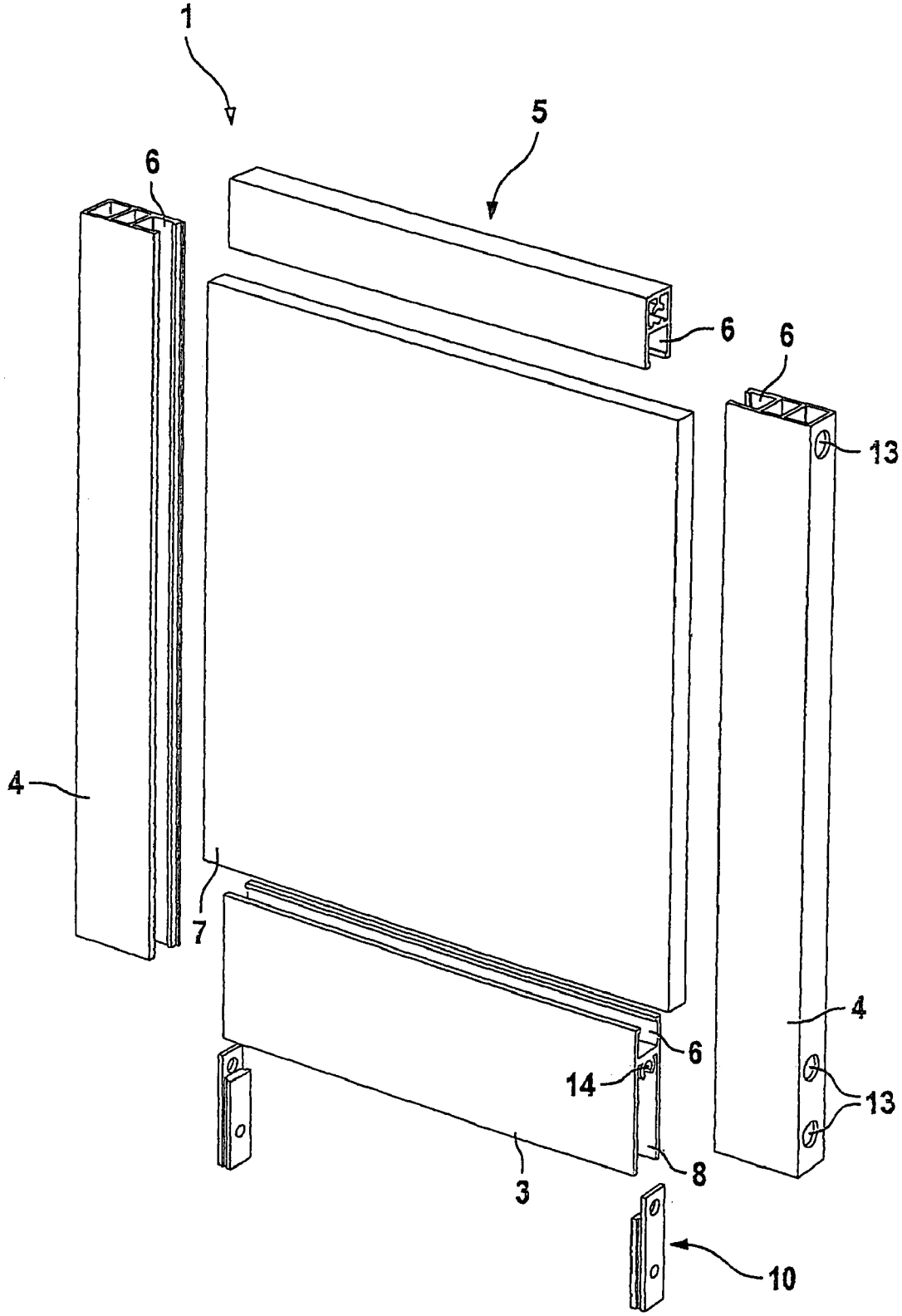
FIG. 2 shows an exploded view of parts of a door according to the invention.
Figure 3:
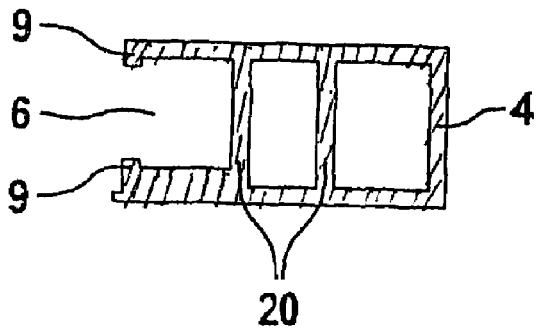
FIG. 3 shows a cross section through a lateral frame profile.
Figure 4A:
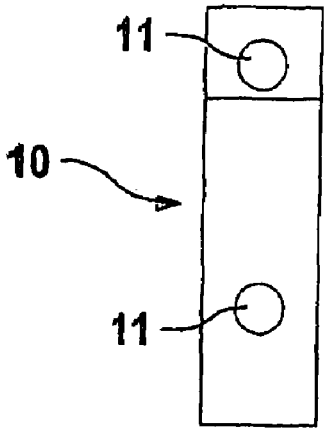
FIGS. 4A, B and C show three views of an intermediate piece according to the invention.
Figure 4B:
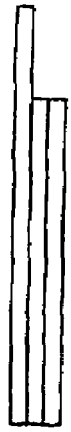
Figure 4C:
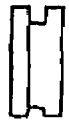
Figure 5:
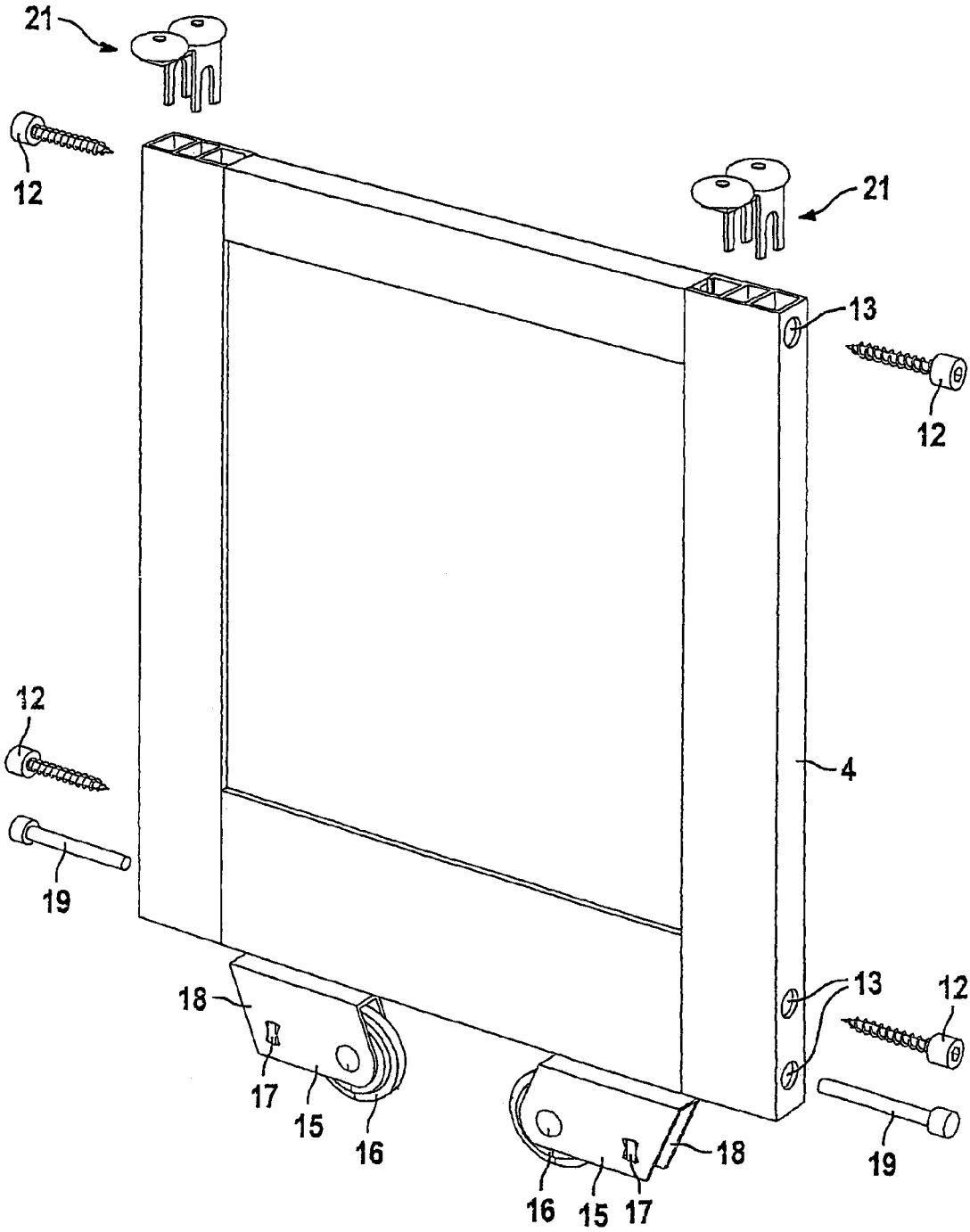
FIG. 5 shows a further exploded view of the partially preassembled sliding door.

The door 1 represented in FIG. 2 has a lower frame profile 3, two lateral frame profiles 4 and an upper frame profile 5. The lower frame profile 3 has substantially an H-shape in cross section and comprises an upper retaining channel 6 for the door leaf 7 and a lower channel 8 in which the runners are to be housed. The lateral frame profiles 4 and the upper frame profile 5 also comprise retaining channels 6 for the door leaf 7. The retaining channels 6 of the lateral frame profiles 4 in particular are, as can be seen from FIG. 3, provided at their front ends with striplike projections 9 which constrict the entrance of the channel 6. An intermediate piece 10 is now fitted on here, this intermediate piece being represented in plan view in FIG. 4A, in side view in FIG. 4B and as seen from above in FIG. 4C. As can be seen in FIG. 4C, this intermediate piece 10 has in its middle a narrower width which corresponds to the clearance between the strips 9. The element has a greater width at its two outer sides, by means of which it fits exactly into the channel behind the strips 9 and into the channel 8. In this way the lower frame profile 3 is aligned flush with the lateral frame profile 4. Screws 12 can then be inserted through openings 13 in the frame profile 4 into the upper screw holes 11 and be screwed into the part 14 of the lower frame profile 3. The screws 12 here are shown in FIG. 5. The screws 12 here bear against the intermediate piece 10 and are therefore countersunk. FIG. 5 additionally shows retaining elements 15 on which runners 16 are mounted. These retaining elements are provided at 17 with nuts and at 18 with a sloping face. After these retaining elements 15 have been inserted into the lower channel 8 of the lower frame profile 3, adjusting screws 19 are inserted through lateral holes 13 in the lateral frame profiles 4 and bear against the intermediate piece 10 and engage in the nut 17. If these screws 19, which are thus countersunk, are tightened, the angle which is enclosed between the sloping face 18 and the intermediate piece 10 is reduced, with the result that the runner 16 is moved downward and the door is raised. The retaining element 15 here bears at its upper outer portion against the intermediate piece 10.

Since the lateral frame profiles 4 are also provided with holes 13 in their upper part and have intermediate walls 20, as are shown in FIG. 3, it is also possible for the upper fastening screws 12 to have a countersunk arrangement by bearing against the intermediate walls 20. Upper guide rollers 21 are then additionally fitted into the corresponding chambers between the intermediate walls 20 of the lateral profiles 4.

Figure 6:
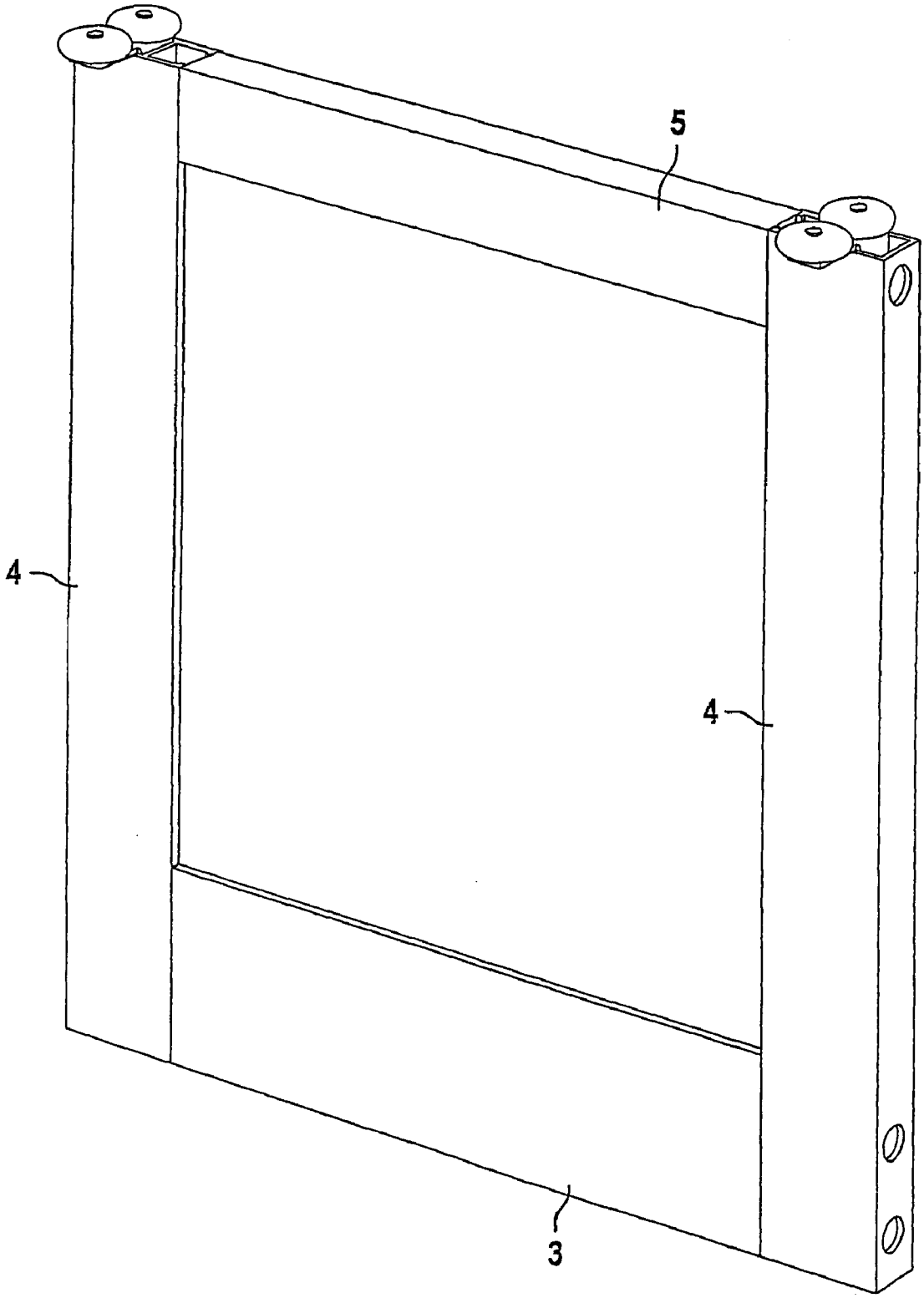
FIG. 6 shows the sliding door of the invention in the assembled state.
Figure 7:
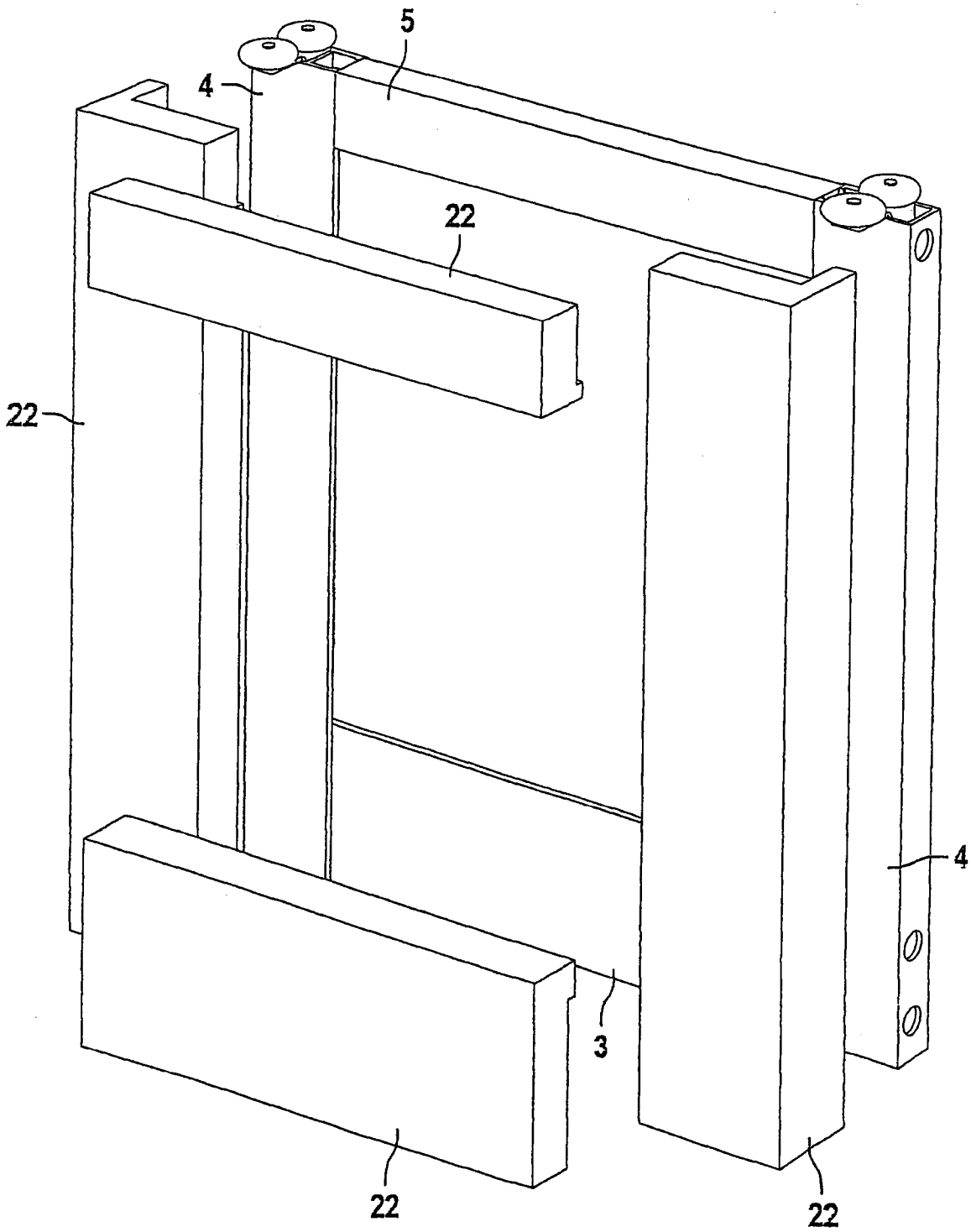
FIG. 7 shows the sliding door of the invention with wooden cladding parts, in an exploded view.
Figure 8:
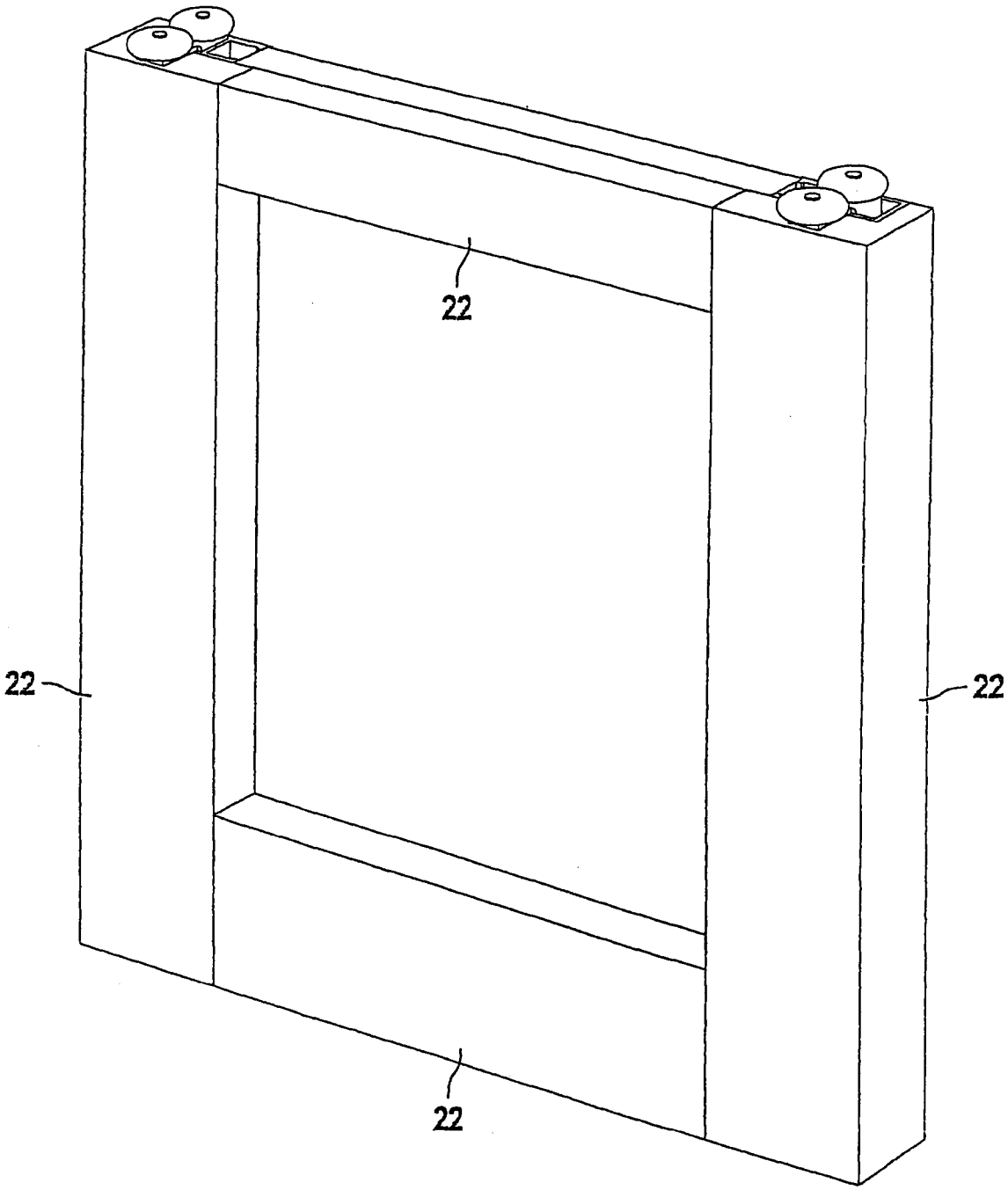
FIG. 8 shows the door of FIGS. 2 to 7 with the wooden cladding mounted.
Figure 9:
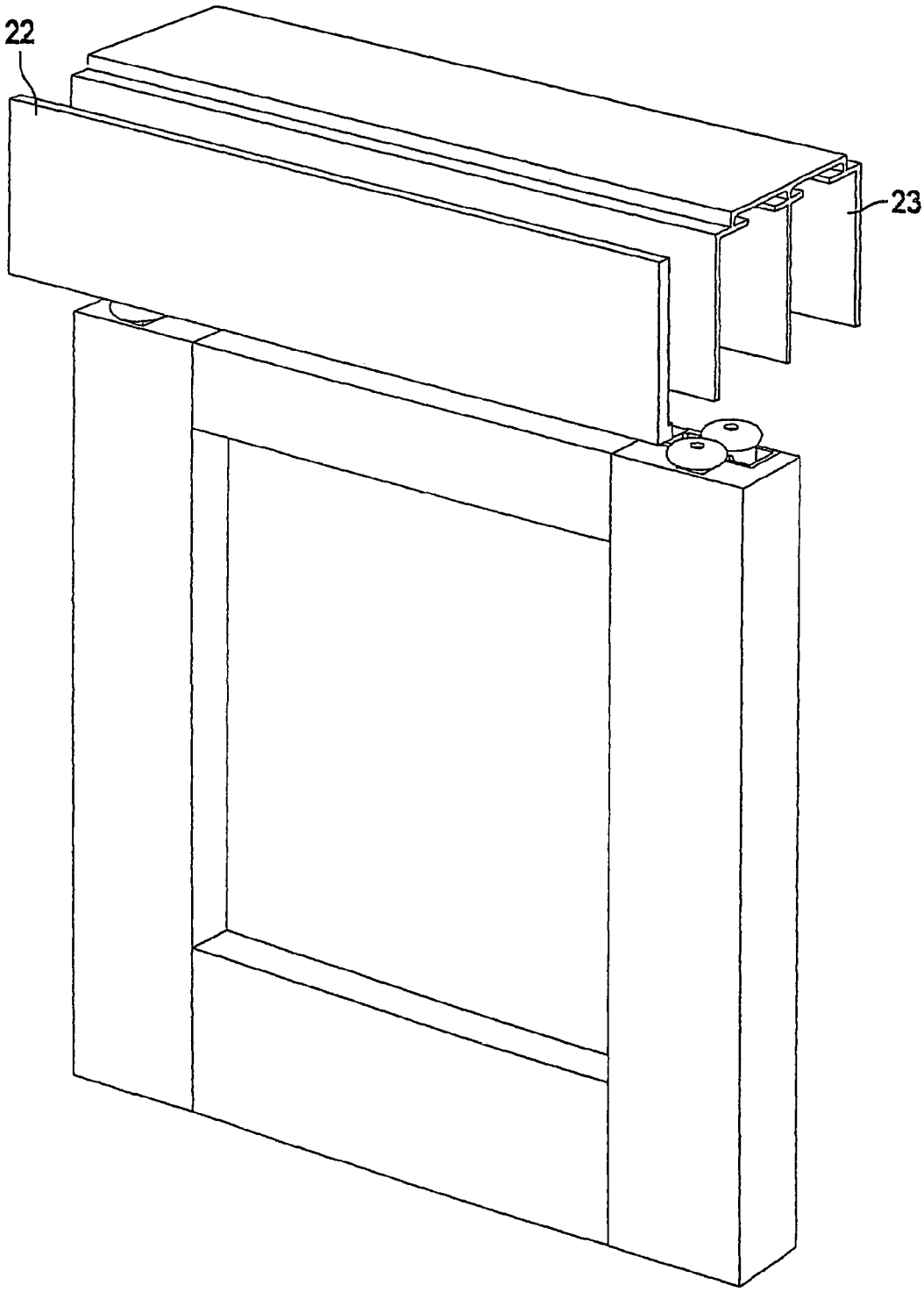
FIG. 9 shows the door according to the invention with an upper runner rail and a wooden cladding element for the latter.
Figure 10:
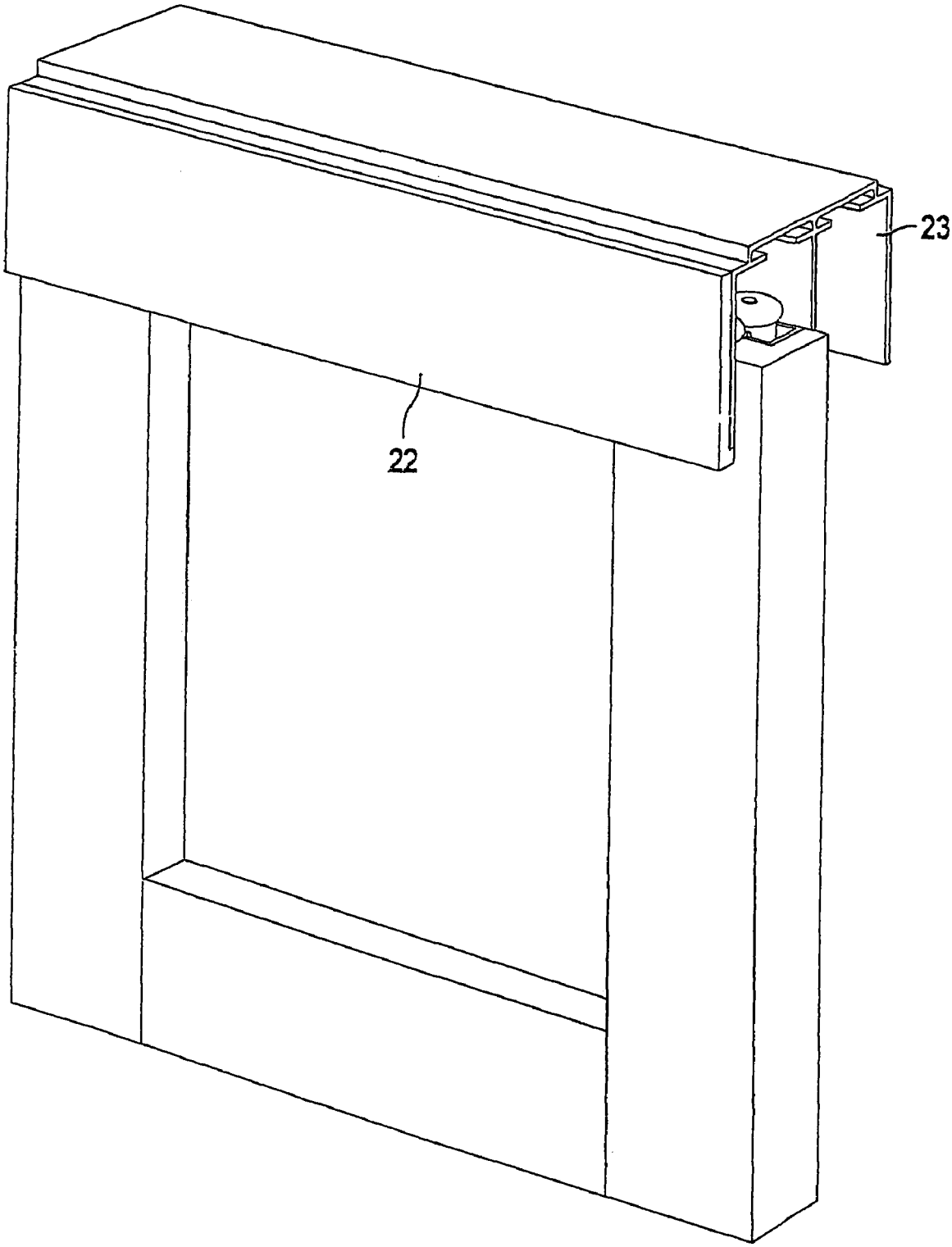
FIG. 10 shows the door in the illustration of FIG. 9 with the upper guide rail and wooden cladding element fitted.

FIG. 6 shows the door of FIGS. 2 to 5 in the assembled state. As is shown in FIGS. 7 and 8, wooden cladding elements 22 may then be additionally fitted onto the frame profiles 3, 4, 5, these elements completely covering the frame profiles 3, 4, 5, as is shown in FIG. 8. None of the frame profiles, which are usually made of metal, in particular aluminum, is thus visible now, only the wooden cladding elements 22. FIGS. 9 and 10 additionally show an upper runner rail 23 which is likewise concealed with a wooden cladding element 22.

Figure 11:
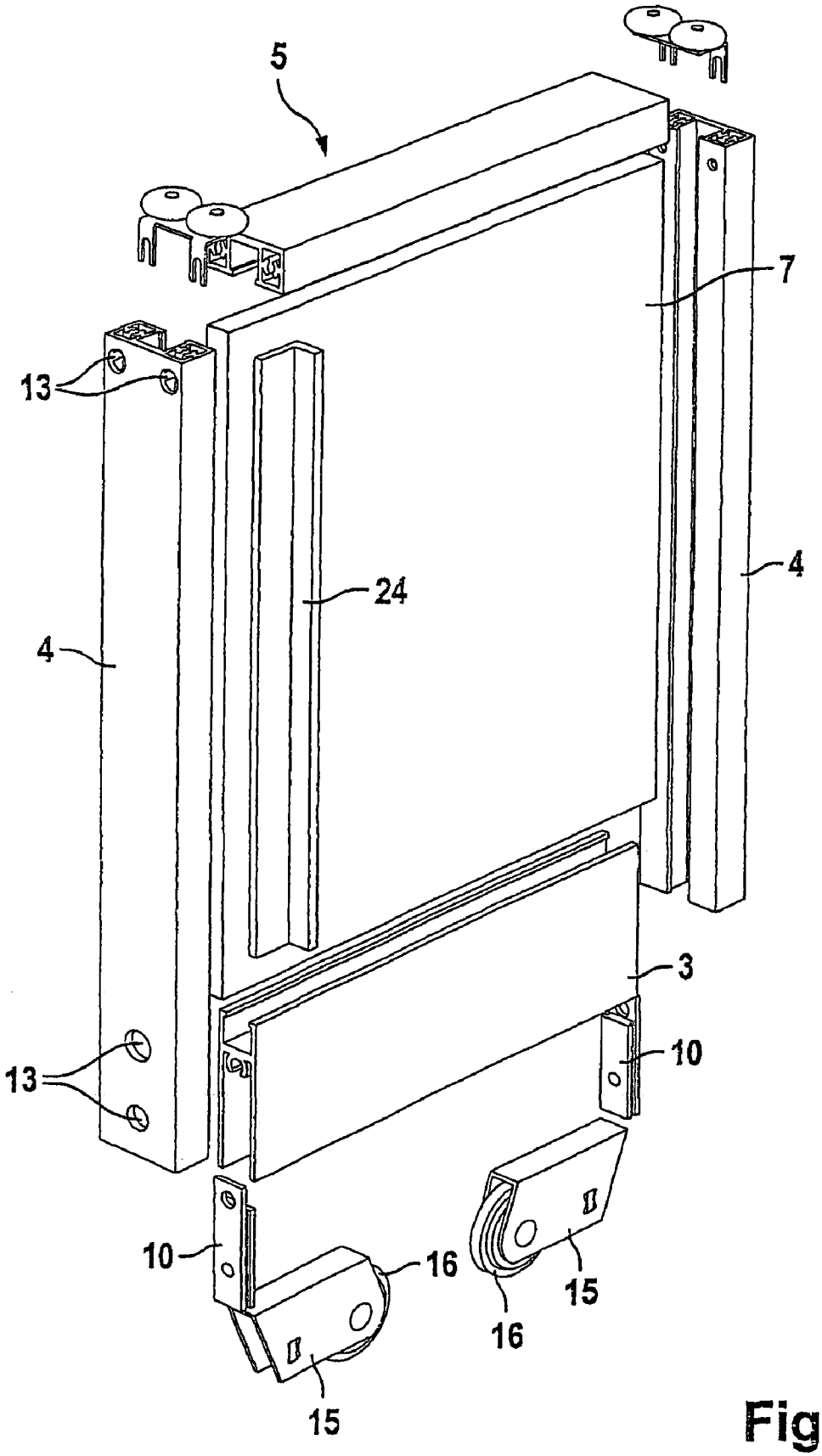
FIG. 11 shows another embodiment of the sliding door according to the invention, in an exploded view.
Figure 12:
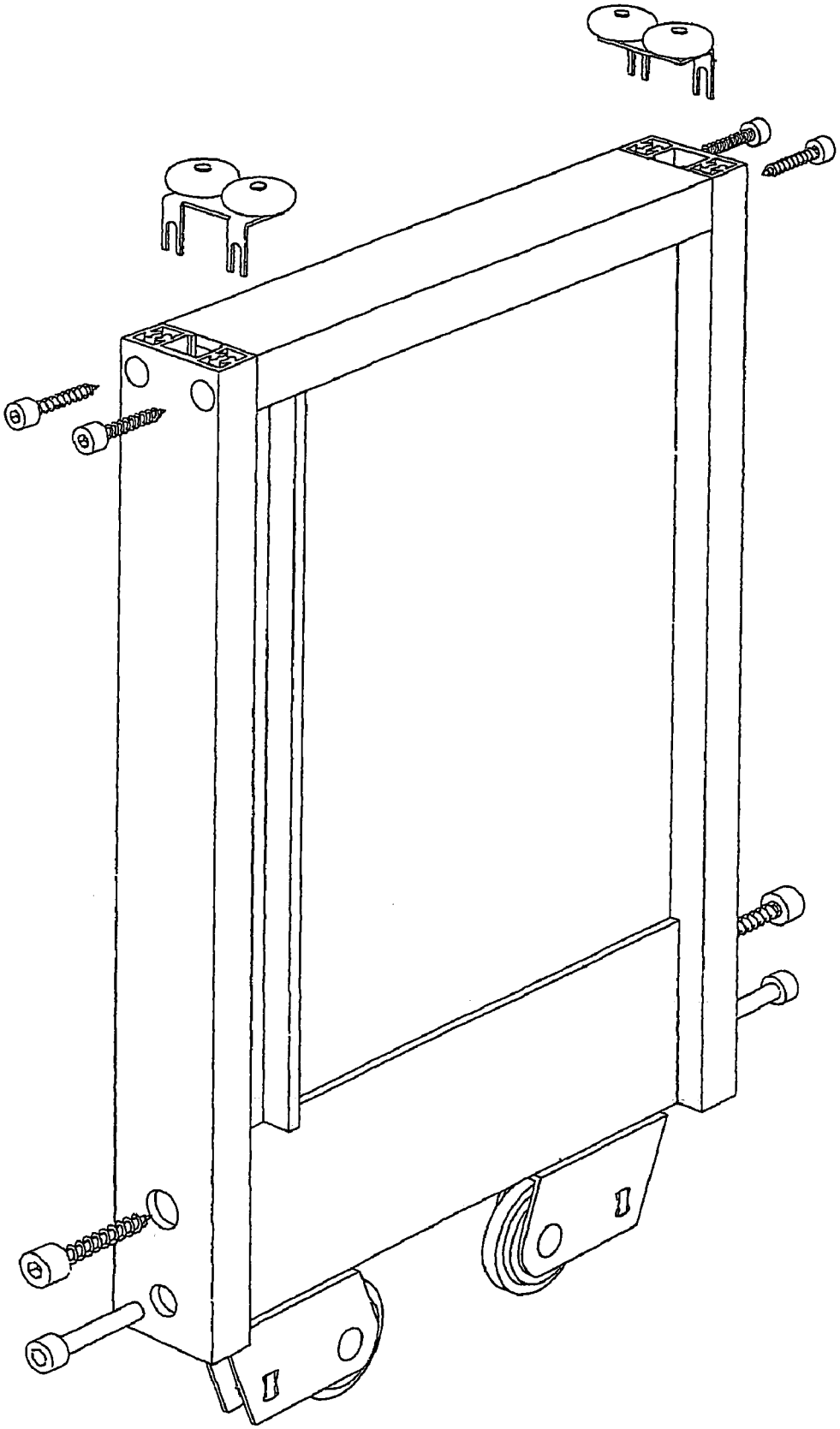
FIG. 12 shows the door of FIG. 11 in the partially assembled state.
Figure 13:
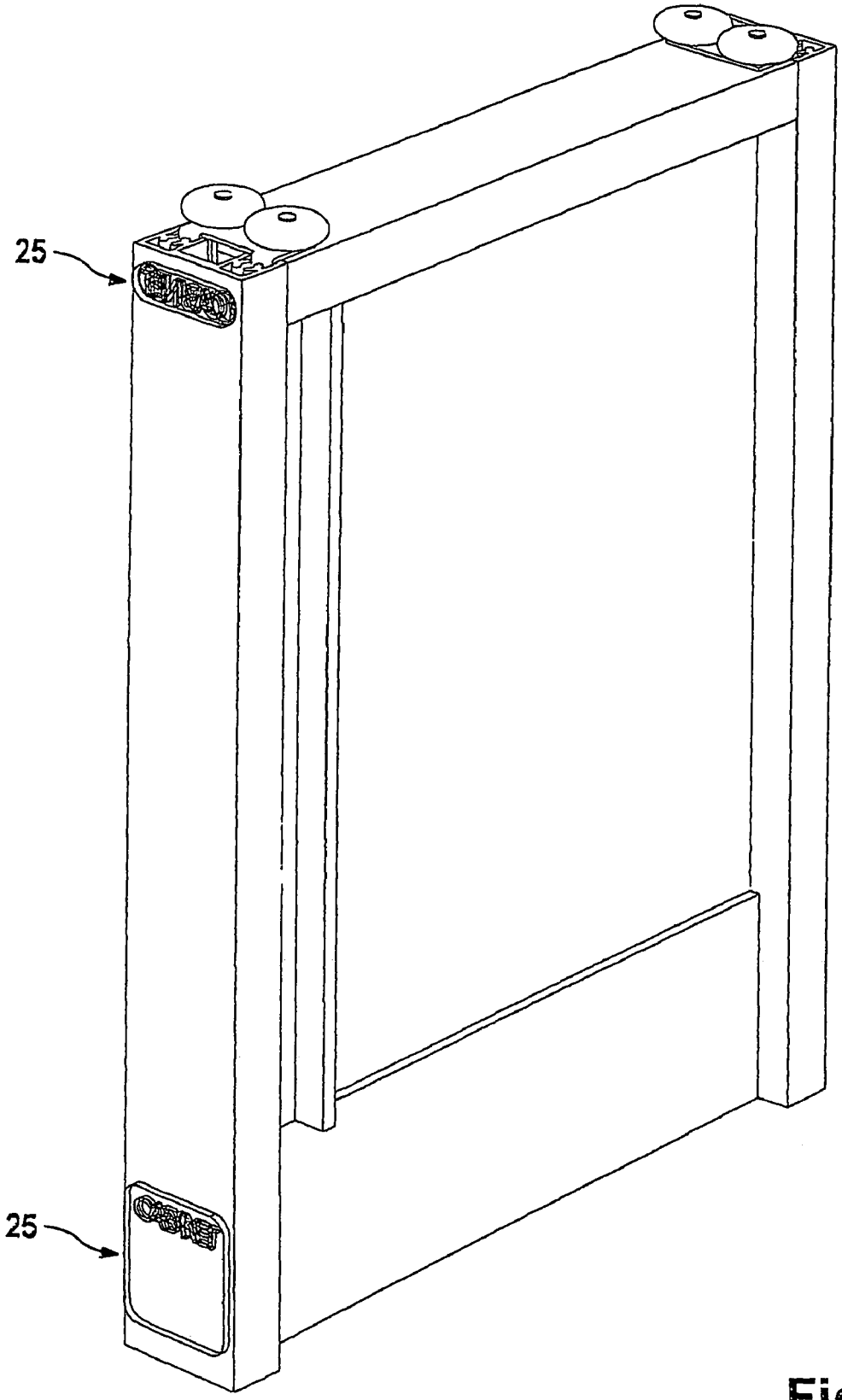
FIG. 13 shows the door of FIGS. 11 and 12 with the flat buffer elements fitted.

The embodiment of FIG. 11 differs from the preceding embodiment not only in the geometric shape but also, in particular, by way of a handle strip 24 which is mounted on the door leaf 7. As is shown in FIG. 13, the screw holes 13 may be covered by flat buffer elements 25. These buffer elements 25 then buffer the impact when the door strikes against the lateral frame 26 which is shown in FIGS. 14 and 15.

Figure 14:
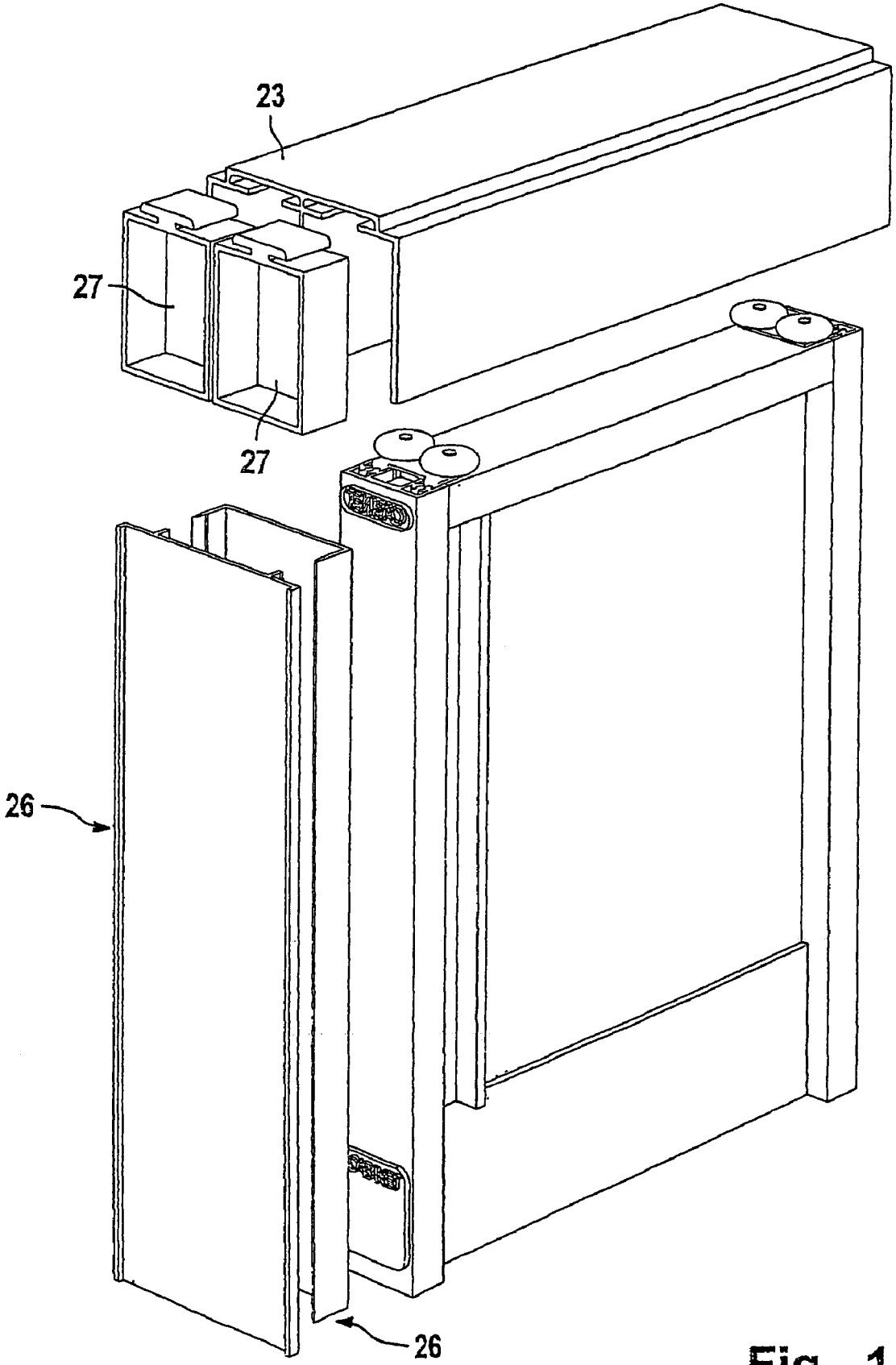
FIG. 14 shows the door of FIGS. 11 to 13 with a lateral frame part and an upper guide rail, in an exploded view.
Figure 15:
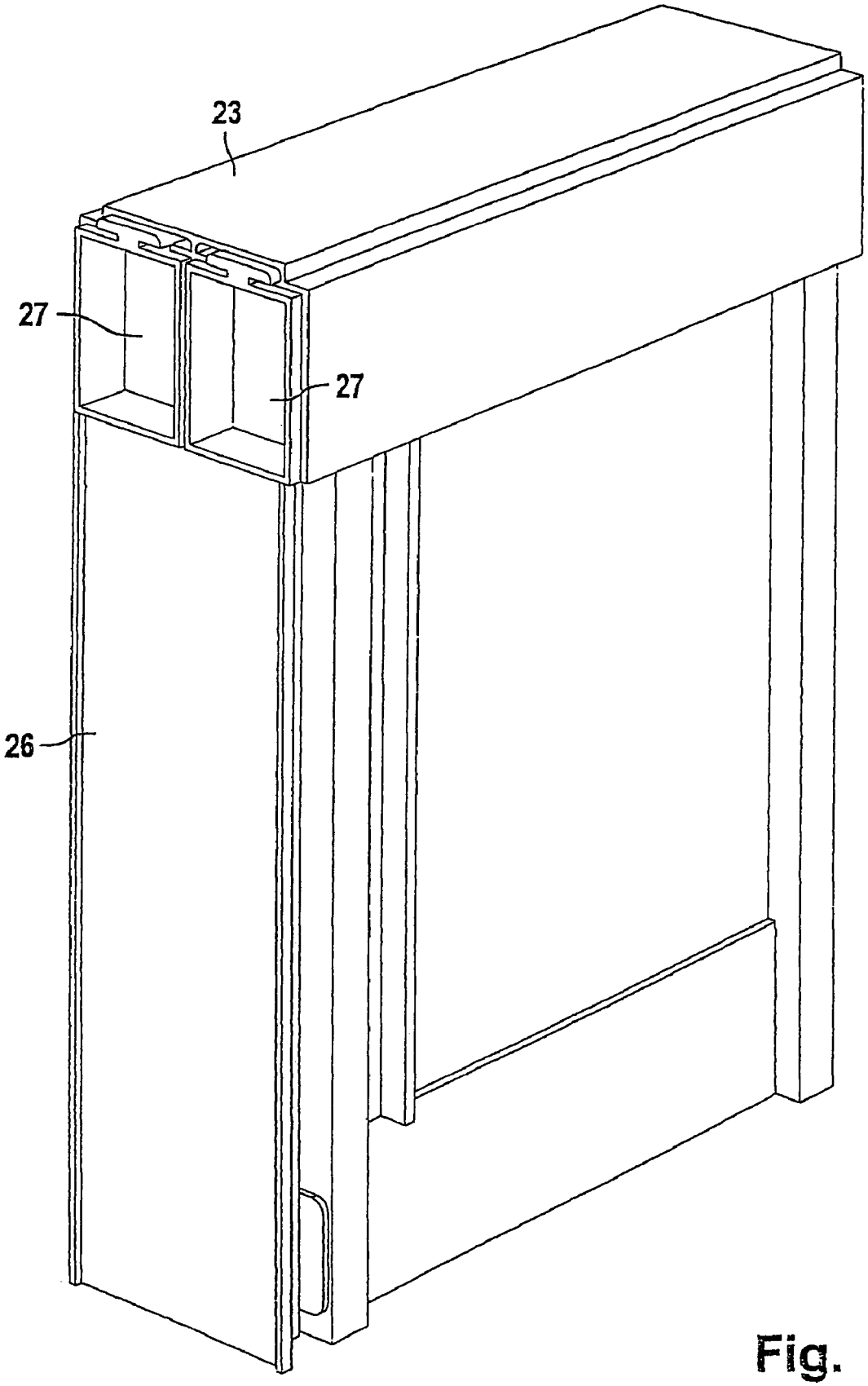
FIG. 15 shows the door of FIG. 14 with the upper guide rail and lateral frame in the assembled state.

FIGS. 14 and 15 additionally show coverings 27 which close off the runner rails 23, with the result that an unbroken appearance and a precise wall termination are achieved.

The invention claimed is:

1. A sliding door comprising a frame having a lower, an upper and two lateral frame profiles, the lateral frame profiles being attached to the lower and upper frame profiles, a door leaf held in the frame in a retaining channel of each of the frame profiles, said lower frame profile has an H-shaped cross section defined by a lower channel and said retaining channel of said lower frame profile, lower runners which are mounted on retaining elements are inserted into the lower channel of the lower frame profile, the retaining elements each being provided with a sloping face and having a threaded element which engages an adjusting screw, the retaining channels of at least the lateral frame profiles each define a width and are each provided with a pair of projections at the opening thereof, each said pair of projections being separated by a distance which is less than said width of a respective one of said retaining channels, and elongate, intermediate mating pieces each fitted onto a respective one of said pair of projections, said intermediate mating pieces each having opposed first and second sides defining channels, a first width, a second width, and a third width, each said first width is substantially commensurate with the width of a respective one of the retaining channels of the lateral frame profiles the second width of each of said intermediate pieces is substantially commensurate with a width of the lower channel of the H-shaped cross section of the lower frame profile, and the channels of each said intermediate piece defining the third width which is substantially commensurate with to the distance separating said respective one of the pair of projections, and said intermediate mating pieces being provided with bores which receive said adjusting screws and fastening screws for attaching said lower and lateral frame profiles together.

2. The sliding door as claimed in claim 1, characterized in that the leaf defines a plane and said lateral frame profiles include intermediate walls extending perpendicularly to the plane.

3. The sliding door as claimed in claim 2, characterized in that the upper and lower frame profiles include projections.

4. The sliding door as claimed in claim 3, characterized in that flat elements comprising an elastic material are mounted on the lateral frame profiles.

5. The sliding door as claimed in claim 2, characterized in that flat elements comprising an elastic material are mounted on the lateral frame profiles.

6. The sliding door as claimed in claim 2, characterized in that the frame profiles are clad with wooden profiles.

7. The sliding door as claimed in claim 1, characterized in that the upper and lower frame profiles include projections.

8. The sliding door as claimed in claim 7, characterized in that the frame profiles are clad with wooden profiles.

9. The sliding door as claimed in claim 7, characterized in that flat elements comprising an elastic material are mounted on the lateral frame profiles.

10. The sliding door as claimed in claim 1, characterized in that flat elements comprising an elastic material are mounted on the lateral frame profiles.

11. The sliding door as claimed in claim 10, characterized in that the flat elements cover screw holes.

12. The sliding door as claimed in claim 11, characterized in that the frame has stop faces for the door leaf.

13. The sliding door as claimed in claim 11, characterized in that the frame profiles are clad with wooden profiles.

14. The sliding door as claimed in claim 10, characterized in that the frame profiles are clad with wooden profiles.

15. The sliding door as claimed in claim 10, characterized in that the frame has stop faces for the door leaf.

16. The sliding door as claimed in claim 15, characterized in that the frame profiles are clad with wooden profiles.

17. The sliding door as claimed in claim 1, characterized in that the frame profiles are clad with wooden profiles.

18. The sliding door as claimed in claim 1, further comprising a handle.

19. The sliding door as claimed in claim 18, characterized in that the handle is a handle strip.

* * * * *

UNITED STATES PATENT AND TRADEMARK OFFICE

CERTIFICATE OF CORRECTION

PATENT NO. : 7,644,542 B2
APPLICATION NO. : 10/558468
DATED : January 12, 2010
INVENTOR(S) : Ambrozus It is certified that error appears in the above-identified patent and that said Letters Patent is hereby corrected as shown below:

Column 5:
Line 1, after "runners" delete "which".

Line 2, after "elements" insert --which--.

Line 16, after "profiles" insert --,--.

Line 21, after "with" delete "to".

Signed and Sealed this

Sixth Day of April, 2010

David J. Kappos

David J. Kappos
*Director of the United States Patent and Trademark Office*